US005500205A

United States Patent [19]

Abbott et al.

[11] Patent Number: 5,500,205

[45] Date of Patent: Mar. 19, 1996

[54] LACHRYMATOR AEROSOL FORMULATIONS

[75] Inventors: Joe L. Abbott, Cumberland; Michael S. Andrade, Central Falls, both of R.I.

[73] Assignee: Enviro Pac International, L.I.c., Lincoln, R.I.

[21] Appl. No.: 200,449

[22] Filed: Feb. 23, 1994

[51] Int. Cl.[6] ..... A61K 9/12

[52] U.S. Cl. ..... 424/401; 424/43; 424/45; 424/195.1; 514/944

[58] Field of Search ..... 424/44, 40, 43, 424/45, 484, 195.1; 252/305; 260/404; 514/627, 944

[56] References Cited

U.S. PATENT DOCUMENTS

| | | | |
|---|---|---|---|
| 4,093,710 | 6/1978 | Saas et al. | 424/44 |
| 4,546,112 | 10/1985 | LaHann et al. | 514/627 |
| 4,980,169 | 12/1990 | Oppenheimer et al. | 424/439 |
| 5,010,056 | 4/1991 | Boghen et al. | 514/12 |
| 5,035,882 | 7/1991 | Hussein et al. | 424/58 |
| 5,061,478 | 10/1991 | Yarkony et al. | 424/45 |
| 5,094,782 | 3/1992 | Chen et al. | 260/404 |
| 5,158,761 | 10/1992 | Kamishita et al. | 424/45 |
| 5,178,879 | 1/1993 | Adekunle et al. | 514/944 |
| 5,217,708 | 6/1993 | Pinknay | 424/45 |
| 5,248,063 | 9/1993 | Abbott | 222/95 |
| 5,305,582 | 4/1994 | Abbott | 53/470 |

FOREIGN PATENT DOCUMENTS

| | | |
|---|---|---|
| 49-35198 | 9/1974 | Japan . |

*Primary Examiner*—Thurman K. Page
*Assistant Examiner*—Raj Bawa
*Attorney, Agent, or Firm*—Popham, Haik, Schnobrich & Kaufman, Ltd.

[57] ABSTRACT

Aerosol lachrymator formulations are provided having all natural pepper extracts as the active ingredient. The lachrymator formulations are useful in self-defense devices. The formulations are non-toxic and have a broader spectrum of activity than man-made lachrymators. These aerosol formulations rely on a carbon dioxide propellant, which is generated in situ.

11 Claims, No Drawings

LACHRYMATOR AEROSOL FORMULATIONS

FIELD OF THE INVENTION

This invention pertains to new lachrymator aerosol formulations useful in self-defense devices. The formulations include a non-toxic lachrymator, preferably a naturally occurring pepper extract or its chemical equivalent. When effectively applied, these formulations repel or disable threatening or unwanted animals, including mammals, reptiles, fish, insects, and other pests.

BACKGROUND OF THE INVENTION

Pepper extracts and their chemical equivalents are widely used throughout the food industry. They are commercially available in combination with soybean oil and in combination with propylene glycol. Some varieties, such as oleoresin capsicum, are available as neat oils.

Aside from their obvious uses in the food industry, pepper extracts have been shown to be useful in pharmaceutical applications. Likewise, others claim to have used naturally occurring pepper extracts and their chemical equivalents effectively as active agents in lachrymator formulations for self-defence devices. These pepper formulations have proven to be effective substitutes for MACE® and other man-made chemical agents used to debilitate attackers and threatening animals.

U.S. Pat. No. 5,217,708 describes a sprayable CAPSICUM LACHRYMATOR. The formulations of the '708 patent address a number of shortcomings in similar prior art devices. For example, the '708 formulations do not contain FREON® or other chlorinated fluorocarbon (CFC) propellant. Evidence that CFCs deplete the ozone layer has led to widespread restrictions on the availability and use of CFCs as propellants.

Pepper extract lachrymators have been shown to be more effective than the man made lachrymators against crazed or drug-induced attackers. In addition to their more broad spectrum of use, these lachrymators, when properly formulated, are more humanitarian tools as they are non-toxic and their effect is temporary and entirely reversible.

As the '708 patent demonstrates, however, devising the proper balance of active ingredients, carrier and propellant for capsicum-based aerosol lachrymators is a difficult task. Of the fifteen examples shown in the '708 patent, only one formulation was reported to be satisfactory and did not result in settling, separation of the ingredients, or inadequate dispersion of the resulting mixture.

It is an object of the present invention to provide lachrymator formulations that are stable mixtures. It is another object of the present invention to provide lachrymator formulations that can be aerosolized and dispersed effectively and reliably. It is yet another object of the present invention to provide lachrymator formulations that contain effective, non-toxic, and environmentally compatible propellant systems.

THE INVENTION

The subject of the present invention is aerosol lachrymator formulations useful for repelling or debilitating unwanted or threatening animals. For example, the formulations are useful for defending against human attackers, but can also be used in repelling dangerous animals such as dogs. The formulations have also been shown to have a repellant effect on reptiles and fish. They are also useful in repelling insects and other pests such as wasps, hornets, and tent caterpillar moths.

The present invention provides stable, non-toxic lachrymator formulations having effective, environmentally compatible propellants, and excellent aerosolization and dispersion properties.

The products of the present invention comprise lachrymator formulations having as their active ingredients pepper extract(s). These active ingredients, or lachrymatory agents, are preferably selected from among all natural, food grade pepper extracts. Further, these lachrymatory agents are preferably selected from among capsaicin-containing materials such as oleoresin capsicum, capsicum frutencens, capsicum annum, and capsicum extract. Alternatively, capsaicin itself, including synthetic capsaicin, will also be useful in the formulations of the present invention.

It is contemplated that various chemical equivalents or other lachrymatory agents are also useful in the lachrymator formulations of the present invention. For example, it is contemplated that formulations comprising piperine, isopiperine, chavicine, iso-chavicine, zingerone, mustard oil, horseradish extract, hot pepper oil, hot pepper extract, and mixtures thereof are useful in the lachrymator formulations of the present invention.

The preferred lachrymatory agent is oleoresin capsicum. Oleoresin capsicum is commercially available as an oil from flavoring and spice manufacturers such as the McCormick Spice Co., Baltimore, Md., and Flavor & Fragrance Specialties, Franklin Lakes, N.J. To minimize toxicity, it is preferred that food grade oleoresin capsicum be used in these formulations.

The pepper extract or chemical equivalent used in the present formulations are combined with carriers or diluents to form a lachrymator component (also referred to herein as "Component A"). Preferred carriers include polyoxyethylene derivatives of polysorbate, benzyl alcohol, isopropyl alcohol (IPA), and water. The preferred polysorbate derivatives include polyoxyethylene (20) sorbitan monooleate (Tween 80), which is commercially available from Aldrich Chemical Company, Inc. and ICI Americas.

The formulations of the present invention further comprise a propellant component (also referred to herein as "Component B"). The preferred propellant is $CO_2$, and the propellant generating components include citric acid and aqueous sodium bicarbonate. In preferred embodiments the citric acid is added to the isopropanol mixture that makes up the lachrymator component. When combined with the aqueous sodium bicarbonate, the formulation generates the $CO_2$ propellant.

A preferred lachrymator/carrier component combines oleoresin capsicum, Tween 80, benzyl alcohol, isopropyl alcohol, and citric acid. Preferably, these ingredients are combined in the following weight percent ratios relative to the entire lachrymator aerosol formulation: about 2–6 wt % oleoresin capsicum; about 2–10 wt % Tween 80; about 1–5 wt % benzyl alcohol; and about 25–45 wt % isopropyl alcohol. It is contemplated that similar quantities of other pepper extracts or their chemical equivalents will fulfill the objectives of the present invention.

The propellant component preferably comprises about 2–6 wt % sodium bicarbonate and about 30–45 wt % water[1]. Preferred formulations further comprise an aliquot of equal parts water and isopropanol to purge the dip tube inside the aerosol container after charging the container with the lachrymator component and the propellant component.

[1] Unless stated otherwise, all recitations of percent composition refer to percent by weight; and furthermore, refer to percent composition of the entire lachrymator formulation as opposed to that of a particular component or mixture.

The lachrymator component and the propellant generating component are combined and packaged in a sealed aerosol container. When the two components of the propellant mixture are combined the mixture releases $CO_2$, which pressurizes the contents of the aerosol container and acts as the propellant gas.

The propellant components used in the lachrymator formulations of the present invention are more thoroughly described in co-owned and commonly assigned U.S. patent application Ser. No. 08/020,174, filed Feb. 22, 1993, and entitled "METHOD FOR TWO-STAGE PRESSURIZATION OF DISPENSING CONTAINER", the disclosure of which is hereby incorporated by reference.

These propellant components generate high dispensing pressure and achieve substantially complete product expulsion from the container. Moreover, when the aerosol containers are properly charged, purged, and sealed, the present formulations are completely expelled with excellent dispersion as there will be no particulate matter left in the valve, valve stem, or dip tube to impair expulsion and dispersion of the product.

The propellant formulations consistently provide excellent expulsion and dispersion of product without the need for more complex mechanical expulsion devices, which are costly, bulky, and prone to breakdown. Likewise, the propellant gas of the present formulations is environmentally compatible, non-toxic, and non-flammable.

The propellant mixture is formulated with the lachrymator component according to a variety of methods. In the preferred method, the aerosol container is first charged with the lachrymator component, which contains the citric acid/isopropanol combination, and the valve is crimped onto the container; the aqueous sodium bicarbonate solution is then charged to the vessel through the valve stem; the valve dip tube is then purged with an aliquot of equal parts water/isopropanol; and the valve actuator is attached.

It is contemplated that the order of addition of the citric acid and sodium bicarbonate components may be reversed by adding a citric acid/isopropanol aliquot to the container after combining the lachrymator/carrier component and the aqueous sodium bicarbonate component. This then would be followed by purging the dip tube with the water/IPA component as needed.

The foregoing mixtures are combined and packaged according to various methods for preparing and packaging aerosol formulations as is known in the art.

Thus, the preferred formulations of the present invention comprise a three component mixture: the lachrymator/carrier component (Component A); the propellant component (Component B); and a purging component (Component C). The following examples illustrate some of the preferred lachrymator formulations of the present invention.

EXAMPLES

Example 1

| | |
|---|---|
| Component A: | |
| 2.5% | 1.2 g. of oleoresin capsicum (1.5 million Heat Units) |
| 5% | 2.4 g. of Tween 80 |
| 2% | 0.96 g. of benzyl alcohol |

-continued

| | |
|---|---|
| 37.45% | 17.976 g. of isopropyl alcohol |
| 3.49% | 1.675 g. of citric acid |
| Component B: | |
| 4.304% | 2.065 g. of sodium bicarbonate |
| 36.95% | 17.736 g. of $H_2O$ |
| Component C: | |
| 4.34% | 2.08 g. of $H_2O$ |
| 4.34% | 2.08 g. of isopropyl alcohol |

Example 2

| | |
|---|---|
| Component A: | |
| 5% | 2.4 g. of Oleo resin capsicum (1.5 Million Heat Units) |
| 5% | 2.4 g. of Tween 80 |
| 2% | 0.96 g. of benzyl alcohol |
| 34.95% | 16.776 g. of isopropyl alcohol |
| 3.49% | 1.675 g. of citric acid |
| Component B: | |
| 4.304% | 2.065 g. of sodium bicarbonate |
| 36.95% | 17.736 g. of $H_2O$ |
| Component C: | |
| 4.34% | 2.08 g. of Water |
| 4.34% | 2.08 g. of IPA |

Example 3

| | |
|---|---|
| Component A: | |
| 5% | 1.15 g. of oleoresin capsicum (1.5 Million Heat Units) |
| 5% | 1.15 g. of Tween 80 |
| 2% | 0.46 g. of benzyl alcohol |
| 34.95% | 8.039 g. of isopropyl alcohol |
| 3.49% | 0.802 g. of citric acid |
| Component B: | |
| 4.304% | 0.99 g. of sodium bicarbonate |
| 36.95% | 8.499 g. of $H_2O$ |
| Component C: | |
| 4.34% | 1 g. of IPA |
| 4.34% | 1 g. of $H_2O$ |

Example 4

| | |
|---|---|
| Component A: | |
| 2.5% | 0.575 g. of oleoresin capsicum (1.5 Million Heat Units) |
| 5% | 1.15 g. of Tween 80 |
| 2% | 0.46 g. of benzyl alcohol |
| 37.45% | 8.614 g. of isopropyl alcohol |
| 3.49% | 0.802 g. of citric acid |
| Component B: | |
| 4.304% | 0.99 g. of sodium bicarbonate |
| 36.95% | 8.499 g. of $H_2O$ |
| Component C: | |
| 4.34% | 1 g. of IPA |
| 4.34% | 1 g. of $H_2O$ |

All of the foregoing examples form stable mixtures exhibiting excellent aerosolization and dispersion properties when properly formulated and packaged.

These formulations are packaged in aerosol containers with appropriate dispensing mechanisms. It is important in the manufacture and use of these apparatus that the dispersion mechanism function consistently and effectively. If the dispersion is inadequate, or fails altogether, the user will likely be in greater danger than prior to resorting to the apparatus.

Useful and effective aerosol containers are known in the art and include those disclosed in U.S. Pat. No. 5,248,063, issued Sep. 28, 1993, the disclosure of which is hereby incorporated by reference.

Similarly, aerosol dispensing mechanisms and canisters or containers useful for packaging and dispensing the formulations of the present invention are disclosed in co-owned and commonly assigned U.S. patent application Ser. No. 08/150,611, filed Nov. 10, 1993 and entitled "LOCKABLE ACTUATOR FOR A DISPENSING CANISTER" the disclosure of which is hereby incorporated by reference.

These and other embodiments of the foregoing invention will be readily understood by those skilled in the art. Accordingly, the invention is not confined to the foregoing embodiments, but instead is defined by the following claims.

What is claimed is:

1. An aerosol lachrymator formulation comprising a lachrymator carrier component comprising capsaicin, isopropanol, and citric acid; and a carbon dioxide propellant generating component comprising an aqueous sodium bicarbonate solution.

2. The formulation of claim 1 further comprising a polyoxyethylene derivative of polysorbate.

3. The formulation of claim 2 wherein said polyoxyethylene derivative is polyoxyethylene (20) sorbitan monooleate.

4. The formulation of claim 3 wherein said lachrymator component further comprises benzyl alcohol.

5. An aerosol lachrymator formulation comprising:

Component A:

2–6 wt % oleoresin capsicum;
2–10 wt % polyoxyethylene (20) sorbitan monooleate;
1–5 wt % benzyl alcohol;
25–45 wt % isopropyl alcohol;
1-5 wt % citric acid;

Component B:

2–6 wt % sodium bicarbonate;
30–45 wt % water;

Component C:

2–6 wt % water; and
2–6 wt % isopropanol.

6. An aerosol lachrymator formulation comprising:

Component A:

2.5–5 wt % of oleoresin capsicum;
4–6 wt % of polyoxyethylene (20) sorbitan monooleate;
1–3 wt % benzyl alcohol;
34–38 wt % isopropyl alcohol;
3–4 wt % citric acid;

Component B:

4–5 wt % sodium bicarbonate;

-continued

36–38 wt % of $H_2O$;

Component C:

4–5 wt % of $H_2O$; and
4–5 wt % of isopropyl alcohol.

7. An aerosol lachrymator formulation comprising:

Component A:

2.5 wt % of oleoresin capsicum;
5 wt % of polyoxyethylene (20) sorbitan monooleate;
2 wt % of benzyl alcohol;
37.45 wt % of isopropyl alcohol;
3.49 wt % of citric acid;

Component B:

4.304 wt % of sodium bicarbonate;
36.95 wt % of $H_2O$;

Component C:

4.34 wt % of $H_2O$; and
4.34 wt % of isopropyl alcohol.

8. An aerosol lachrymator formulation comprising:

Component A:

5 wt % of oleoresin capsicum;
5 wt % of polyoxyethylene (20) sorbitan monooleate;
2 wt % of benzyl alcohol;
34.95 wt % of isopropyl alcohol;
3.49 wt % of citric acid;

Component B:

4.304 wt % of sodium bicarbonate;
36.95 wt % of $H_2O$;

Component C:

4.34 wt % of $H_2O$; and
4.34 wt % of isopropyl alcohol.

9. A self-defense device comprising the following aerosol lachrymator formulation:

Component A:

2–6 wt % of oleoresin capsicum;
2–10 wt % polyoxyethylene (20) sorbitan monooleate;
1–5 wt % benzyl alcohol;
25–45 wt % isopropyl alcohol;
1–5 wt % citric acid;

Component B:

2–6 wt % sodium bicarbonate;
30–45 wt % of water;

Component C:

2–6 wt % of water; and
2–6 wt % of isopropanol in an aerosol canister comprising an aerosol dispensing means.

10. A method for manufacturing an aerosolized self-defense device comprising:

first formulating a lachrymator component by combining:

2–6 wt % oleoresin capsicum;

2–10 wt % polyoxyethylene (20) sorbitan monooleate therefore;

1–5 wt % benzyl alcohol;

25–45 wt % isopropyl alcohol; and

1–5 wt % citric acid;

in an aerosol container;

sealing the lachrymator component in an aerosol container; and subsequently adding a propellant component comprising 30–45 wt % water and 2.6 wt % sodium bicarbonate to said lachrymator component in said sealed aerosol container.

11. The method of claim 10 wherein the propellant component is added through a valve stem, after which the valve stem is purged with an aliquot of equal parts water and isopropyl alcohol.

* * * * *